United States Patent [19]

Yokoyama

[11] 4,370,282

[45] Jan. 25, 1983

[54] CONTROL DEVICE FOR ACCELERATION PUMP

[75] Inventor: Junichi Yokoyama, Ebina, Japan

[73] Assignee: Nissan Motor Company, Limited, Kanagawa, Japan

[21] Appl. No.: 287,177

[22] Filed: Jul. 27, 1981

[30] Foreign Application Priority Data

Jul. 28, 1980 [JP] Japan ..... 55-106666[U]

[51] Int. Cl.[3] ..... F02M 7/08

[52] U.S. Cl. ..... 261/34 B; 261/39 A; 261/DIG. 74

[58] Field of Search ..... 261/34 B, 34 A, DIG. 74, 261/39 A

[56] References Cited

U.S. PATENT DOCUMENTS

| | | | |
|---|---|---|---|
| 2,552,056 | 5/1951 | Orr, Jr. | 261/34 B |
| 2,641,237 | 6/1953 | Deschamps | 261/34 A |
| 2,662,757 | 12/1953 | Mock | 261/39 A |
| 3,474,994 | 11/1969 | Kell | 261/34 A |
| 3,677,526 | 7/1972 | Pierlot | 261/39 A |
| 3,872,189 | 3/1975 | Brown et al. | 261/39 A |
| 4,108,951 | 8/1978 | Niwa et al. | 261/34 B |
| 4,187,814 | 2/1980 | Phelan et al. | 261/DIG. 74 |
| 4,225,535 | 9/1980 | Takamura et al. | 261/34 B |

FOREIGN PATENT DOCUMENTS

| | | | |
|---|---|---|---|
| 2261557 | 5/1974 | Fed. Rep. of Germany | 261/34 A |
| 53-8433 | 1/1978 | Japan | 261/34 B |

OTHER PUBLICATIONS

Weissler; "Popular Mechanics"; 8–78; pp. 95–97, 131, 132.

*Primary Examiner*—Tim R. Miles

*Attorney, Agent, or Firm*—Lowe, King, Price & Becker

[57] ABSTRACT

A device for controlling an acceleration pump for a carburetor includes a positioning member, a stopper and an actuating means. The positioning member is preferably formed integrally with a piston slidably set in the acceleration pump. The stopper is arranged to move in a direction perpendicular to a sliding direction of the piston. According to the positions of the stopper, the positioning member engages the stopper at a plurality of predetermined positions so that the stroke of the piston may change. The actuating means may be bellows or others. The bellows contains therein an air pressure equal to the standard air pressure at a low place whereby the bellows can expand at a high place due to the air pressure difference. In addition, the actuating means can be controlled in response to the ambient temperature.

8 Claims, 5 Drawing Figures

CONTROL DEVICE FOR ACCELERATION PUMP

BACKGROUND OF THE INVENTION

The present invention relates to a device for controlling an acceleration pump for a carburetor.

When the opening degree of a throttle valve is suddenly changed from a small one to a large one in order to accelerate the engine speed, air is promptly supplied into the engine cylinder, but fuel is not supplied into it in proportion thereto because a part of the fuel is adhered onto an induction passage wall so that the fuel cannot be sufficiently supplied into the engine. Thus, the air-fuel mixture becomes tentatively lean.

For such a reason, the engine cannot be promptly accelerated even if the throttle valve is widely opened. To solve this problem, an acceleration device is provided to supply an increased volume of fuel when the throttle valve is suddenly opened to a large extent.

FIG. 1 shows a conventional acceleration device which is a piston type acceleration pump. A carburetor body 1 has an induction passage P wherein a throttle valve 2 is arranged. A piston 3 in the acceleration pump is made of metal or the like. When throttle valve 2 opens, a throttle lever 4 rotates together with the throttle valve 2 so that a connecting rod 5 moves upwardly whereby a pump lever 7 rotates around a shaft 6 counterclockwise. As a result, the right end of the pump lever 7 moves up while the left end thereof moves down so that the piston 3 moves down against the biasing force of a return spring 8. When the opening degree of the throttle valve 2 becomes small, the piston 3 returns to its original position by the biasing force of the return spring 8.

When the piston 3 moves up, the fuel 10 in a float chamber 9 opens an inlet valve 11 so that the fuel flows into a cylinder 12. When the piston 3 again moves down, that is, when the throttle valve 2 is opened to a large extent, the fuel within the cylinder 12 opens an outlet valve 13 so that the fuel can be supplied through a pump nozzle 14 into the induction passage P upstream of the throttle valve 2.

According to the opening degree of the throttle valve 2, a rate of supplying the fuel into the engine is controlled so as to obtain good acceleration characteristics.

In such a conventional acceleration device, however, only one rate of supplying the fuel is predetermined so as to be matched to the air density under the standard atmospheric pressure. Therefore, it is not matched to another air density, for example, at a high place such as a mountain. Although the density of the air supplied into the engine is small at a high place, the same increased fuel is supplied thereinto. Thus, the air-fuel mixture becomes too rich. As a result, fuel consumption worsens, and exhausted noxious substances such as HC, CO cannot be easily disposed.

SUMMARY OF THE INVENTION

According to the present invention, a device for controlling an acceleration pump for a carburetor includes a positioning member, a stopper and an actuating means. The positioning member is preferably formed integrally with a piston slidably set in the acceleration pump. The stopper is arranged to move in a direction perpendicular to a sliding direction of the piston. According to the positions of the stopper, the positioning member engages the stopper at a plurality of predetermined positions so that the stroke of the piston may change. The actuating means may be bellows or others. The bellows contains therein an air pressure equal to the standard air pressure at a low place whereby the bellows can expand at a high place due to the air pressure difference. In addition, the actuating means can be controlled in response to the ambient temperature.

Therefore, an object of the present invention is to provide a device for controlling an acceleration for a carburetor wherein an air-fuel ratio can be controlled according to change of an atmospheric pressure particularly during the engine acceleration.

A further object of the present invention is to provide a device for controlling an acceleration for a carburetor wherein an air-fuel ratio can be controlled according to change in ambient temperature in addition to the atmospheric pressure.

DETAILED DESCRIPTION OF THE PREFERRED EMBODIMENTS

The same or corresponding parts are designated by the same references through all figures of the drawings.

Figure 1:
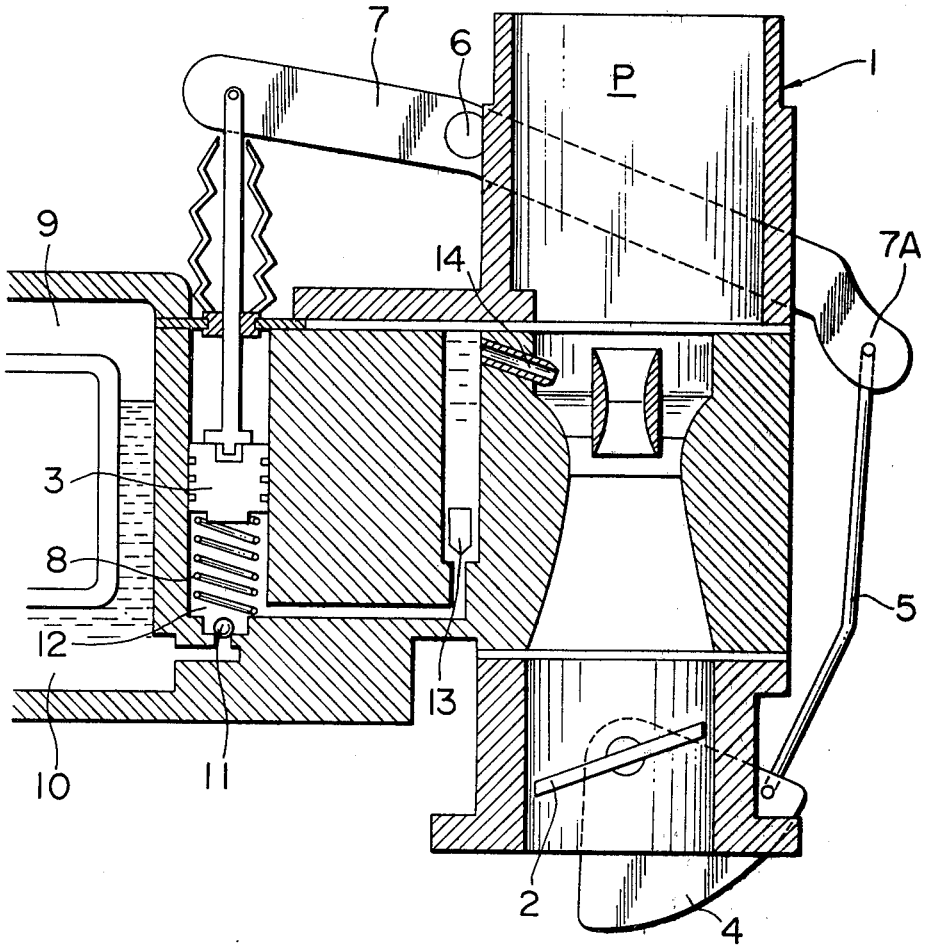
FIG. 1 (PRIOR ART)
FIG. 1 is a sectional view showing a conventional pump device for controlling air-fuel mixture ratio.
Figure 2:
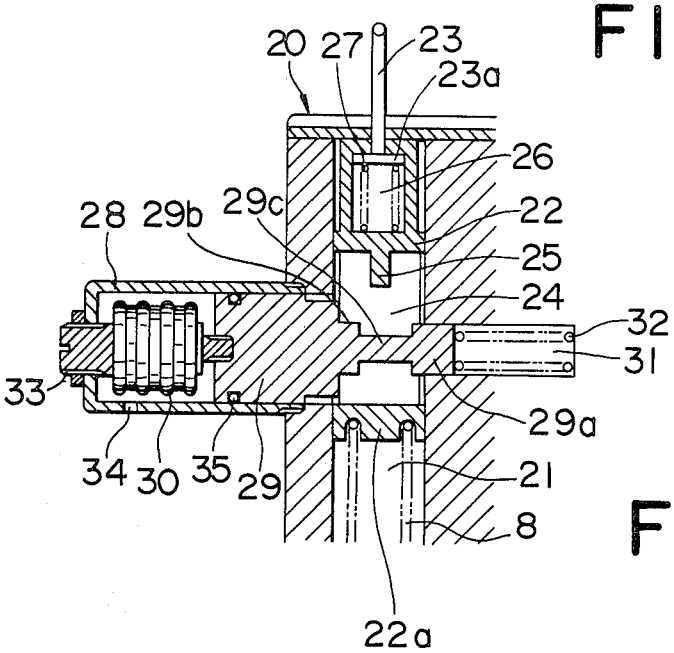
FIG. 2 is a sectional view showing an essential portion of a device according to an embodiment of the present invention.

Referring now to FIG. 2, a carburetor body 20 is provided to be connected to an engine (not shown) in a conventional manner. An acceleration pump cylinder 21 is vertically formed in the carburetor body 20. A piston 22 is slidably placed in the acceleration pump cylinder 21. A push rod 23 is connected between the pump lever 7 as shown in FIG. 1 and the piston 22 so that the movement of the pump lever 7 is transferred to the piston 22.

Figure 3:
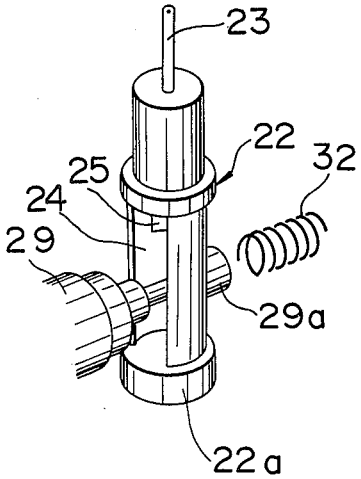
FIG. 3 is a perspective view of the essential portion as shown in FIG. 2 with some parts being eliminated for clarity.

As shown in FIG. 3, the piston 22 has an elongated space 24 which penetrates through piston 22 in the lateral direction. A pin-like positioning member 25 formed integrally with the piston 22 protrudes into space 24 from its base portion.

The piston 22 also has a spring chamber 26 in which a flange portion 23*a* of the push rod 23 is slidably placed. The push rod 23 is biased by the force of a coil spring 27 disposed between the flange portion 23*a* thereof and the lower end of the spring chamber 26 toward the other end of the spring chamber 26 in such a direction that the piston 22 moves up. The piston 22 is also biased by the force of the return spring 8 arranged within the cylinder 21. The upper end of the spring 8 engages the lower end portion 22*a* of the piston 22.

A cylindrical stopper casing 28 extends from the carburetor body 20 in a direction perpendicular to the sliding direction of the piston 22 or the axis of the cylinder 21. A stopper 29 is slidably placed in the stopper casing 28 in such a manner that the stopper 29 passes through the space 24 of the piston 22. Actuating means 30 is provided at the backside of the stopper 29.

The front portion 29a of the stopper 29 passes through the space 24 of the piston 22 and is slidably inserted into a cylinder portion 31 formed in the carburetor body 20 opposite stopper casing 28. A spring 32 is placed within the cylinder portion 31 to bias the stopper 29 so that the backside of the stopper 29 is pressed against the actuating means 30 by the biasing force of the spring 32.

The stopper 29 has at its intermediate portion first and second small diameter portions 29b, 29c in a stepped form near the front end 29a.

When the stopper 29 is in its return position (the original position as shown), the second small diameter portion 29c having the smallest diameter comes in front of the positioning member 25.

The actuating means 30 for the stopper 29 may be formed of bellows containing air sealed therein having an atmospheric pressure at a low place.

The base portion of the actuating means 30 is fitted through an adjusting screw 33 to the stopper casing 28. By adjusting the adjusting screw 33, the original or return position of the stopper 29 can be changed.

An opening 34 is formed in the casing 28 so that the atmospheric pressure outside of the casing 28 communicates with the actuating means 30. An O-ring 35 is disposed between the stopper 29 and the casing 28 to provide sealing therebetween.

In operation, when the engine is at a low place of the standard atmospheric pressure, the pressure in the bellows type actuating means 30 is substantially the same as that introduced through the opening 34 into the casing 28. Therefore, the actuating means 30 does not actuate the stopper 29 so that the stopper 29 does not move at its original position. If the throttle valve 2 is widely opened, the push rod 23 in response to the opening of the throttle valve 2 presses down the piston pin 22 by way of the coil spring 27 until the positioning member 25 contacts the first small diameter portion 29c of the stopper 29. As the piston 22 moves down, the fuel within the cylinder 21 is urged to flow out from the cylinder 21 thereby to be supplied into the induction passage P through the pump nozzle 14 protruding thereinto as shown in FIG. 1.

When the engine is at a high place, the air pressure in the bellows 30 is larger than that out of the casing 28. Thus, the bellows 30 expand so that it pushes the stopper 29 in the right direction. As the stopper 29 moves in the right direction against the force of the spring 32, the second small diameter portion 29b comes in front of the positioning member 25.

Accordingly, when the throttle valve 2 is widely opened, the positioning member 25 moves down until it contacts the second small diameter portion 29b. Thereafter, even if the throttle valve 2 is further opened, the piston 22 does not move down and only the push rod 23 moves down within the spring chamber 26 against the biasing force of the coil spring 27. Thus, the stroke of the piston 22 is shortened by the difference in height between the first and second small diameter portions 29b, 29c. As a result, the fuel supply rate is relatively decreased, resulting in adjustment of the air-fuel mixture ratio during engine acceleration, according to ambient pressure.

Figure 4:
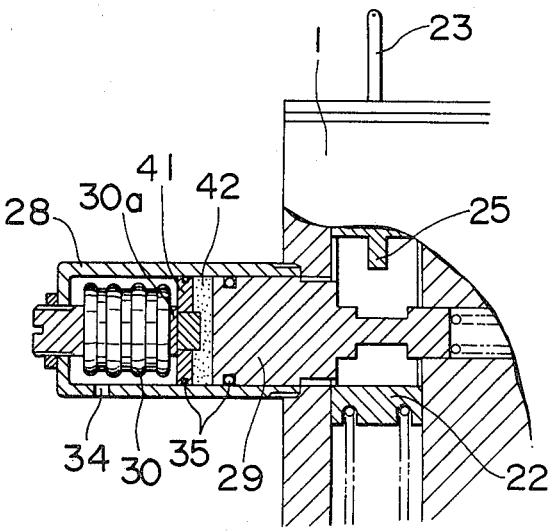
FIG. 4 is a sectional view showing an essential portion of a second embodiment of the present invention.

FIG. 4 shows a further embodiment of the present invention which is substantially the same as the embodiment as shown in FIGS. 2 and 3 except the construction within the casing 28. A piston 41 having a good thermoconductivity is placed at a free end 30a of the actuating means 30. A thermowax 42 is disposed between the piston 41 and the stopper 29 in a sealed condition.

In operation, in response to changing of the atmospheric pressure, the stopper 29 moves as in the embodiment shown in FIGS. 2 and 3. In addition, the ambient temperature is transferred through the piston 41 to the thermowax 42. As a result, the volume of the thermowax 42 changes in response to the ambient temperature. For instance, at a high temperature, the thermowax 42 expands so that the stopper 29 is urged to move in the right direction.

Accordingly, when the induction air is low in density due to its high temperature, the air-fuel mixture ratio can be adjusted.

Figure 5:
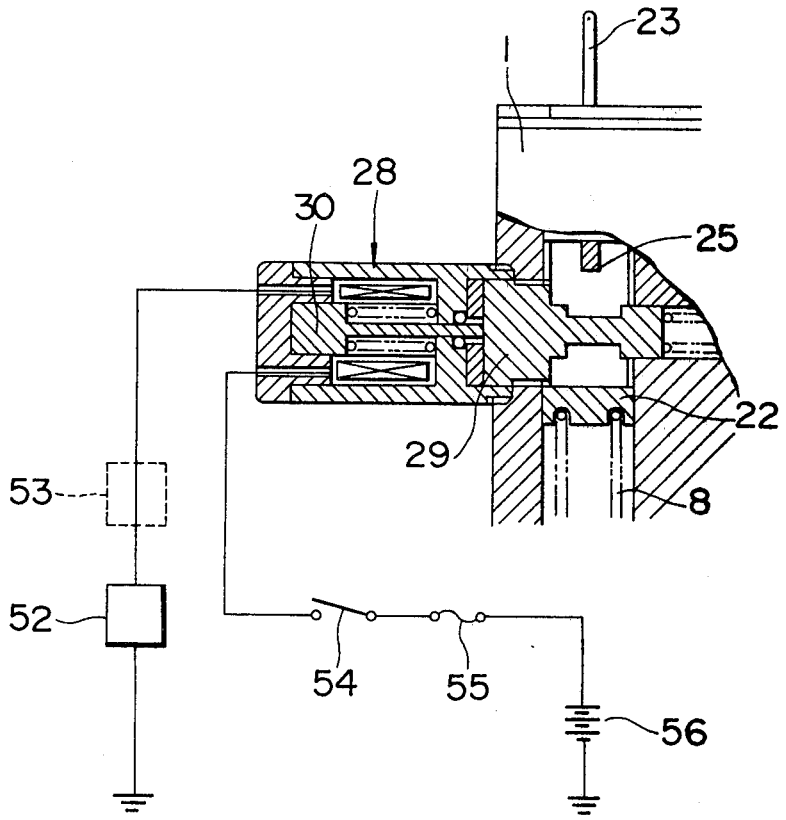
FIG. 5 is a sectional view showing an essential portion of a third embodiment of the present invention.

FIG. 5 shows another embodiment of the present invention. As the actuating means 30 for the stopper 29, an "ON-OFF" type solenoid is provided to control the positions of the stopper 29. A circuit for actuating the solenoid is controlled by an atmospheric pressure sensor 52 and an ambient temperature sensor 53. An ignition switch 54, a fuse 55 and a battery 56 are connected to the solenoid 30 in series.

Although in the shown embodiment both the ambient temperature and pressure sensors are used, only the ambient pressure sensor 52 can be used to control the positions of the stopper 29.

The present invention can be applied to an electronic carburetor although a general carburetor is employed in cooperation with an acceleration pump control device in all the embodiments shown and described.

What is claimed is:

1. A device for controlling an acceleration pump for a carburetor, comprising:

a piston slidably moveable in a first direction in the acceleration pump;

a positioning member formed in the piston of the acceleration pump;

stopper means moveable in a second direction substantially perpendicular to the first direction for stopping the positioning member at a plurality of predetermined different positions as a function of the stop position of the stopper means in the second direction, enabling adjustment of the piston stroke in the first direction;

actuating means for moving the stopper means in the second direction in response to variations in atmospheric pressure, said actuating means being operable to shorten the piston stroke as a function of decreasing atmospheric pressure so that the air-fuel ratio can be adjusted;

said actuating means including a bellows having sealed therein air and the like at a predetermined air pressure substantially equal to the standard air pressure at a low elevation;

said actuating means further including a thermowax member disposed between the bellows and the stopper means to enable the thermowax to actuate and move the stopper in the second direction in response to variations in ambient temperature.

2. A device according to claim 1, wherein said piston includes:

an elongated space;

the positioning member being formed integrally with the piston and protruding downwardly into the space;

a spring chamber formed in the piston; and wherein the stopper means includes:

a plurality of small diameter portions in a stepped form;

a front end portion biased toward the actuating means;

and further comprising:

a push rod operating in response to opening of a throttle valve; and a spring placed within the spring chamber for biasing one end of the push rod in such a way that after the piston is stopped by the stopper only the push rod moves down against the biasing force of the spring.

3. A device for controlling an acceleration pump for a carburetor comprising:

a carburetor body;

an acceleration pump having an acceleration pump cylinder vertically formed in the carburetor body;

a piston slidably placed in the acceleration pump cylinder in a first direction;

a cylindrical stopper casing extending in a second direction substantially perpendicular to the first direction;

a stopper slidably placed in the stopper casing;

said piston having therein a spring chamber formed in the first direction near the upper end of the piston, a hole extending through a portion of the piston, and a pin-like positioning member formed integrally with the piston and protruding into the hole in the first direction;

a push rod having at its lower end a flange like portion slidably placed in the spring chamber;

a coil spring disposed in the spring chamber at the flange like portion of the push rod thereby to bias the push rod upwardly in the first direction;

a return spring placed at the lower end of the piston to bias the piston upwardly in the first direction;

said stopper extending through the hole of the piston;

said carburetor body having a cylinder portion opposing the stopper casing;

actuating means responsive to variations in atmospheric pressure for moving the stopper through the hole;

a spring placed within the cylinder portion of the carburetor body to bias the stopper so that the stopper is pressed against the actuating means by the biasing force thereof;

said stopper having at its intermediate portion first and second small diameter portions in a stepped form, enabling the pin-like positioning member to selectively engage the first and second small diameter portions during stopper movement in the second direction caused by the actuating means in response to variations in atmospheric pressure to selectively shorten the piston stroke as a function of decreasing atmospheric pressure, thereby adjusting the air-fuel ratio.

4. The device of claim 3, wherein said actuating means includes a bellows having air sealed therein at an air pressure substantially equal to a standard air pressure at a low elevation.

5. The device of claim 3, wherein said actuating means includes a solenoid controlled by an ambient pressure sensor.

6. The device of claim 4, further comprising a thermowax disposed between the bellows and the stopper for actuating and moving the stopper in the second direction in response to variations in ambient temperature.

7. A device of claim 5, wherein said solenoid is controlled by both an ambient temperature sensor and said ambient pressure sensor.

8. A device for controlling an acceleration pump for a carburetor, comprising:

a piston slidably moveable in a first direction in the acceleration pump;

a positioning member formed in the piston of the acceleration pump;

stopper means moveable in a second direction substantially perpendicular to the first direction for stopping the positioning member at a plurality of predetermined different positions as a function of the stop position of the stopper means in the second direction, enabling adjustment of the piston stroke in the first direction;

a first actuating means physically located adjacent the stopper means for moving the stopper means in the second direction in response to variations in atmospheric pressure; and a second actuating means physically located adjacent the first actuating means for moving the stopper means in the second direction in response to variations in ambient temperature;

said first and second actuating means each being operable to vary the piston stroke respectively according to changes in atmospheric pressure and ambient temperature.

* * * * *